US005085359A

United States Patent [19]

Thomas

[11] Patent Number: 5,085,359

[45] Date of Patent: Feb. 4, 1992

[54] GARMENT ACCESSORY DEVICE TO REMOVE PANTS WITH CONSTRICTED CUFFS

[76] Inventor: Carmen J. Thomas, 905 N. Federick St., Arlington, Va. 22205

[21] Appl. No.: 546,370

[22] Filed: Jun. 15, 1990

[51] Int. Cl.[5] ..... A47G 25/90

[52] U.S. Cl. ..... 223/111; 223/120; D2/641

[58] Field of Search ..... 223/111, 112, 120, 116, 223/119; D2/641

[56] References Cited

U.S. PATENT DOCUMENTS

| | | | |
|---|---|---|---|
| 916,508 | 3/1909 | Vietor | 223/111 |
| 3,993,228 | 11/1976 | Fuhr | 223/111 |
| 4,066,194 | 1/1978 | Leland | 223/111 |
| 4,638,932 | 1/1987 | Keller | 223/111 |
| 4,892,239 | 1/1990 | Tomasi | 223/111 |

*Primary Examiner*—Werner H. Schroeder
*Assistant Examiner*—Bibhu Mohanty
*Attorney, Agent, or Firm*—Spencer & Frank

[57] ABSTRACT

A pants puller for use in removing pants with constricted cuffs includes a base and a clamping mechanism mounted on the base. The clamping mechanism includes a pair of upwardly oriented clamping arms which are normally open. A person steps onto the base so as to deposit her cuff between the clamping arms, and then closes the clamping arms by stepping on a further arm of the clamping mechanism. The clamping arms are preferably angled backward slightly to permit the person to shift her weight to the foot stepping on the further arm of the clamping mechanism while straightening the other foot to withdraw it from the constricted cuff.

12 Claims, 1 Drawing Sheet

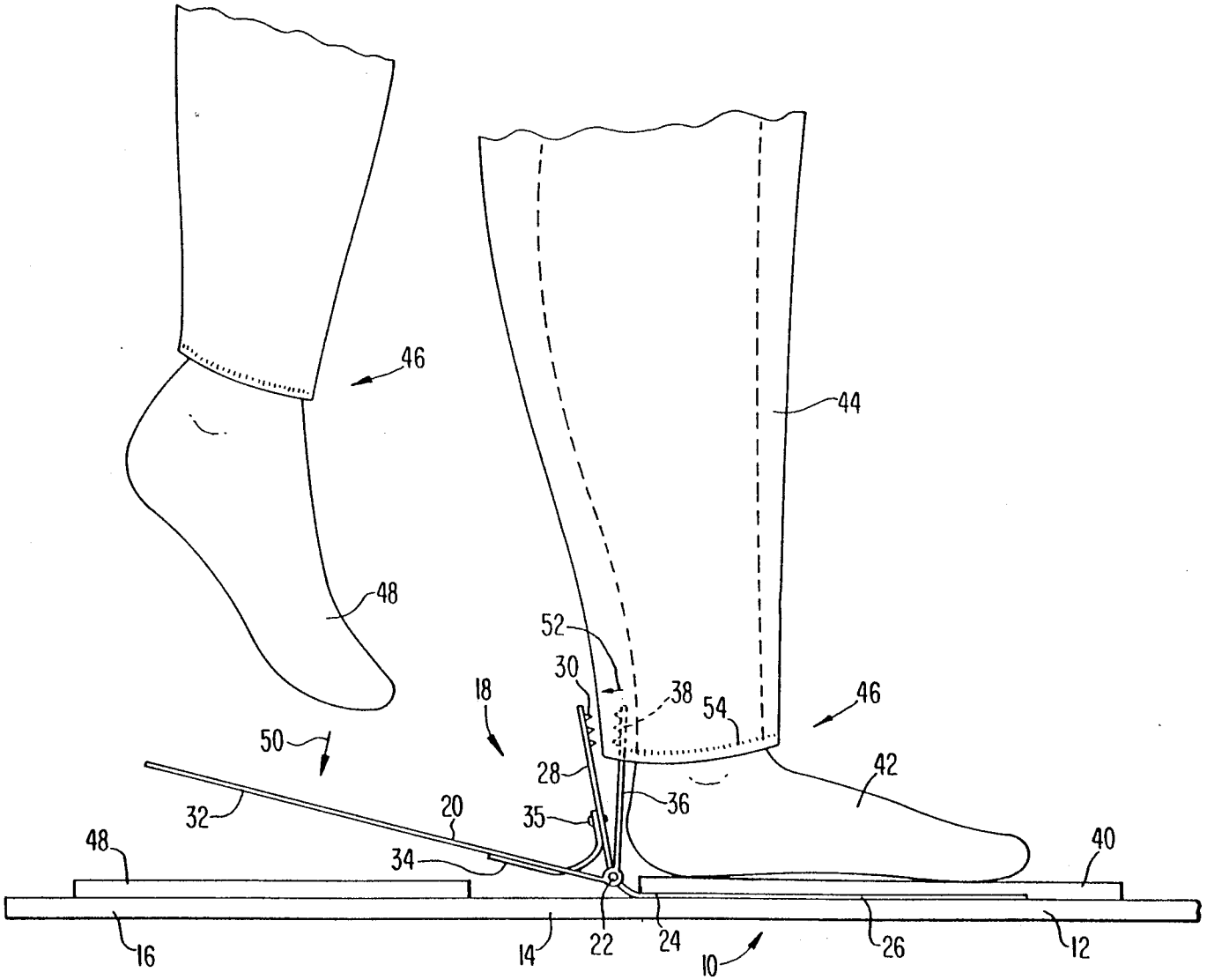
10
12
14
16
18
20
22
24
26
28
30
32
34
35
36
38
40
42
44
46
48
50
52
54

GARMENT ACCESSORY DEVICE TO REMOVE PANTS WITH CONSTRICTED CUFFS

BACKGROUND OF THE INVENTION

The present invention is directed to a pants puller, or an accessory for removing pants with tight or constricted cuffs.

At one time bell bottoms, with legs which flared outward at the cuffs, were popular for women's pants. The changing dictates of fashion have made a new pants design popular. Pants with what might be called the "constricted cuff design" have cuffs that are generally opposite those of bell bottoms. Instead of flaring outward, pants with the constricted cuff design are relatively tight at the cuffs. This may cause problems removing the pants.

Often a woman attempting to remove pants with constricted cuffs must sit or possibly even lie on her back while struggling to withdraw her heels through the constricted cuffs. In an attempt to alleviate this problem, zippers have been provided at the bottom of each leg of the pants so that the cuffs may be loosened for removal. However, such zippers increase the expense of the pants and are frequently aesthetically displeasing.

SUMMARY OF THE INVENTION

The object of the invention is to provide an accessory for facilitating the removal of pants with restricted cuffs (particularly blue-jean type pants), without modifying the pants themselves as by using zippers at the cuffs.

This object can be attained by providing a pants puller which includes a base and a clamping mechanism on the base to grip the cuff of a pants leg so that the wearer can then withdraw her leg from the garment.

BRIEF DESCRIPTION OF THE DRAWING

The sole drawing is a side view illustrating the pants puller of the present invention and the feet and lo legs of a person using the pants puller.

DESCRIPTION OF THE PREFERRED EMBODIMENT

With reference to the drawing, the pants puller of the present invention includes a base 10 with a front portion 12, an intermediate portion 14, and a rear portion 16. The pants puller also includes a clamping mechanism 18 mounted on base 10. Clamping mechanism 18 includes a movable clamp member 20 which is connected by a hinge 22 to a stationary clamp member 24. Each of the clamp members has two arms. Arm 26 of stationary clamp member 24 is attached to the front portion 12 of base 10, and the remaining arm 28 is a clamping arm which rises at an obtuse angle with respect to arm 26 above the intermediate region 14 of base 10. A rubber gripper member 30 is affixed to clamping arm 28 at the upper end thereof. Arm 32 of movable clamp member 20 is disposed above rear portion 16 of base 10, and has an opening not illustrated) through which passes a spring 34. Spring 34 is attached by a fastener 35 to clamping arm 28 of stationary clamp member 24. Spring 34 normally supports movable clamp member 20 so that its clamping arm 36 is approximately vertical. A rubber gripper member 38 is affixed to the upper end of clamping arm 36.

A pad 40 is mounted above arm 26 to receive the foot 42 of a person seeking to remove the leg 44 of pants having constricted cuffs 46. If desired, a pad 48 may be mounted on the rear portion 16 of base 10.

To use the pants puller, the person removes her shoes and places her foot 42 on pad 40 in such a manner that the upper end of clamping arm 36 is inserted between the fabric of the pants and her leg. With her other foot 48, she then steps onto arm 32 of movable clamp member 20, as indicated by arrow 50. This causes movable clamp member 20 to pivot as a whole at hinge 22, so that clamping arm 36 moves toward clamping arm 28 as indicated by arrow 52. The fabric of the pants leg 44 is thus tightly gripped between members 30 and 38, thereby retaining the cuff 46 of the pants as the wearer withdraws her leg. The backward slant of clamping arm 28 (and clamping arm 36 in its pivoted state) facilitates the removal procedure by permitting the person to lean back slightly and straighten her foot 42 while supporting herself on foot 48. Any slippage of the fabric between gripper members 30 and 38 is limited by the fact that such slippage brings the lower hem 54 of pants leg 44 into engagement with the underside of clamping member 38. Thus, even if slippage does indeed occur, the pants leg 44 cannot be removed entirely from clamp assembly 18 until the person lifts her foot 48 and spring 35 restores the clamping arms 28 and 36 to the open position illustrated in the drawing.

After removing one leg of the pants, the person then shifts the position of her feet and repeats the removal procedure. That is, the remaining foot 48 is lowered toward pad 40 in such a manner that clamping arm 36 of movable clamp member 20 is inserted between the leg and the fabric. With the person's weight supported on foot 48, the person then steps on arm 32 with foot 42. While stepping on arm 32, the person shifts her weight backward to the rear foot (i.e., foot 42) while straightening her front foot and removing the remaining leg of the pants. The entire removal process can be accomplished while standing.

Although the present invention has been described using a woman's pants with constricted cuffs as an example, it will be apparent that the pants puller could equally well be used by men or by children wearing pants with constricted cuffs. The references herein to a woman as the wearer of the pants and the use of the feminine pronoun "her" are not intended as limitations, but are instead employed for the sake of verbal simplification.

What I claim is:

1. A pants puller for use by a woman wearing pants with at least one constricted cuff, comprising:

a base having a front portion and a rear portion, the woman stepping onto the base with her toes oriented toward the front portion, and clamping means, affixed to the base, for clamping the fabric of said at least one cuff while the woman withdraws her leg, the clamping means including first and second clamping arms which are movable between a open and a closed position relative to each other, the first clamping arm being stationary with respect to the base and the second clamping arm being movable with respect to the first clamping arm and being disposed between the first clamping arm and the front portion of the base, the clamping means additionally including foot-actuated closure means for moving the second clamping arm toward the rear portion of the base to bring the clamping arms to their closed position after the fabric has been inserted between the clamping arms while the clamping arms were in their open position.

2. The pants puller of claim 1, wherein the base is generally horizontal, and wherein the clamping arms extend upward from the base.

3. The pants puller of claim 2, wherein the clamping means includes a stationary clamp member which is affixed to the base, a movable clamp member, and means for pivotally mounting the movable clamp member, the first clamping arm being provided by the stationary clamp member and the second clamping arm being provided by the movable clamp member.

4. The pants puller of claim 3, wherein the means for pivotally mounting the movable clamp member comprises a hinge.

5. The pants puller of claim 4, wherein the hinge connects the movable clamp member to the stationary clamp member.

6. The pants puller of claim 3, wherein the stationary clamp member includes a further arm, the further arm being attached to the base and being disposed at an angle greater than 90° with respect to the first clamping arm of the stationary clamp member.

7. The pants puller of claim 6, wherein the movable clamp member includes another arm, the another arm of the movable clamp member providing the foot-activated closure means and being disposed at an angle less than 90° with respect to the second clamping arm of the movable clamp member.

8. The pants puller of claim 3, wherein the clamping means further comprises spring means for maintaining the clamping arms in their open position unless the closure means is actuated.

9. A pants puller for use by a woman wearing pants with constricted cuffs, comprising:

a base having a front portion, a rear portion, and an intermediate portion between the front and rear portions, the woman stepping onto the base with her toes oriented toward the front portion; and clamping means for clamping the fabric of one of the cuffs while the woman withdraws her leg, the clamping means including a stationary clamp member having an arm which is affixed to the forward portion of the base and having a clamping arm which extends upward from the base above the intermediate portion thereof, the arms of the stationary clamp member being disposed at an angle greater than 90°, a movable clamp member having a clamping arm and a further arm, the arms of the movable clamp member being disposed at an angle less than 90°, means for pivotally mounting the movable clamp member so that the further arm of the movable clamp member is disposed above the rear portion of the base and so that the clamping arm of the movable clamp member extends upward from the base above the intermediate portion thereof and is positioned between the clamping arm of the stationary clamp member and the forward portion of the base, the clamping arms being pivotable between a open and a closed position relative to each other, gripper members on the movable clamping arms, and means for biasing the clamping arms in their open position to receive said one of the cuffs of a woman who steps onto the forward portion of the base, the clamping arms thereafter being moved to their closed position when the woman steps onto the further arm of the movable clamp member.

10. The pants puller of claim 9, further comprising a pad on the forward portion of the base.

11. The pants puller of claim 9, wherein the means for pivotally mounting the movable clamp member comprises a hinge.

12. The pants puller of claim 11, wherein the hinge connects the movable clamp member to the stationary clamp member.

* * * * *

UNITED STATES PATENT AND TRADEMARK OFFICE

CERTIFICATE OF CORRECTION

PATENT NO. : 5,085,359
DATED : February 4, 1992
INVENTOR(S) : Carmen J. Wood

It is certified that error appears in the above-indentified patent and that said Letters Patent is hereby corrected as shown below:

On the Title page, item [76], inventor: change Carmen J. Thomas--
Carmen J. Wood--

Signed and Sealed this

Twenty-second Day of June, 1993

*Attest:*

Michael K. Kirk

MICHAEL K. KIRK

*Attesting Officer*

*Acting Commissioner of Patents and Trademarks*